US008893919B2

(12) United States Patent
Kabe et al.

(10) Patent No.: US 8,893,919 B2
(45) Date of Patent: Nov. 25, 2014

(54) STORAGE BOX

(71) Applicant: Fuji Xerox Co., Ltd., Tokyo (JP)

(72) Inventors: Yusuke Kabe, Kanagawa (JP); Takaaki Yoshida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/935,789

(22) Filed: Jul. 5, 2013

(65) Prior Publication Data

US 2014/0124515 A1 May 8, 2014

(30) Foreign Application Priority Data

Nov. 5, 2012 (JP) ..... 2012-243500

(51) Int. Cl.
*B65D 5/42* (2006.01)

(52) U.S. Cl.
CPC ..... *B65D 5/4266* (2013.01); *B65D 5/4204* (2013.01)
USPC ..... 220/676; 220/666; 229/122; 229/122.2; 229/117.01

(58) Field of Classification Search
CPC ..... B65D 5/4204; B65D 5/4266
USPC ..... 220/666, 6, 676, 661, 669, 677; 229/117.01, 122, 122.2, 117.05, 229/117.08
See application file for complete search history.

(56) References Cited

U.S. PATENT DOCUMENTS

| | | | | |
|---|---|---|---|---|
| 5,141,149 | A * | 8/1992 | Fulton | 229/103 |
| 5,318,219 | A * | 6/1994 | Smith | 229/117.05 |
| 5,474,230 | A * | 12/1995 | Yotukura | 229/117.04 |
| 6,050,410 | A * | 4/2000 | Quirion | 206/386 |
| 2005/0087590 | A1 * | 4/2005 | Kawagoe et al. | 229/117.01 |
| 2012/0000912 | A1 * | 1/2012 | Potts et al. | 220/553 |
| 2014/0048546 | A1 * | 2/2014 | Kennis | 220/666 |

FOREIGN PATENT DOCUMENTS

JP A-2005-239222 9/2005

* cited by examiner

*Primary Examiner* — Robert J Hicks
*Assistant Examiner* — Kareen Rush
(74) *Attorney, Agent, or Firm* — Oliff PLC

(57) ABSTRACT

A storage box includes a box body that includes a bottom wall and plural side walls including a pair of side walls that oppose each other, the box body having an opening at the top and containing an object, and a pair of lid walls that extend upward from top edges of the pair of side walls and are bent along the top edges so as to cover the opening of the box body. A pair of first lines are formed on the pair of lid walls and the pair of side walls, each first line extending at least partway from a top edge of the corresponding lid wall to a bottom edge of the corresponding side wall and facilitating outward bending of the corresponding side wall when an arm is inserted between the object contained in the box body and the corresponding side wall.

4 Claims, 7 Drawing Sheets

STORAGE BOX

CROSS-REFERENCE TO RELATED APPLICATIONS

This application is based on and claims priority under 35 USC 119 from Japanese Patent Application No. 2012-243500 filed Nov. 5, 2012.

BACKGROUND

Technical Field

The present invention relates to a storage box.

SUMMARY

According to an aspect of the invention, there is provided a storage box including a box body that includes a bottom wall and plural side walls including a pair of side walls that oppose each other, the box body having an opening at the top and containing an object, and a pair of lid walls that extend upward from top edges of the pair of side walls and are bent along the top edges so as to cover the opening of the box body. A pair of first lines are formed on the pair of lid walls and the pair of side walls, each first line extending at least partway from a top edge of the corresponding lid wall to a bottom edge of the corresponding side wall and facilitating outward bending of the corresponding side wall when an arm is inserted between the object contained in the box body and the corresponding side wall.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described with reference to the drawings.

Figure 1:
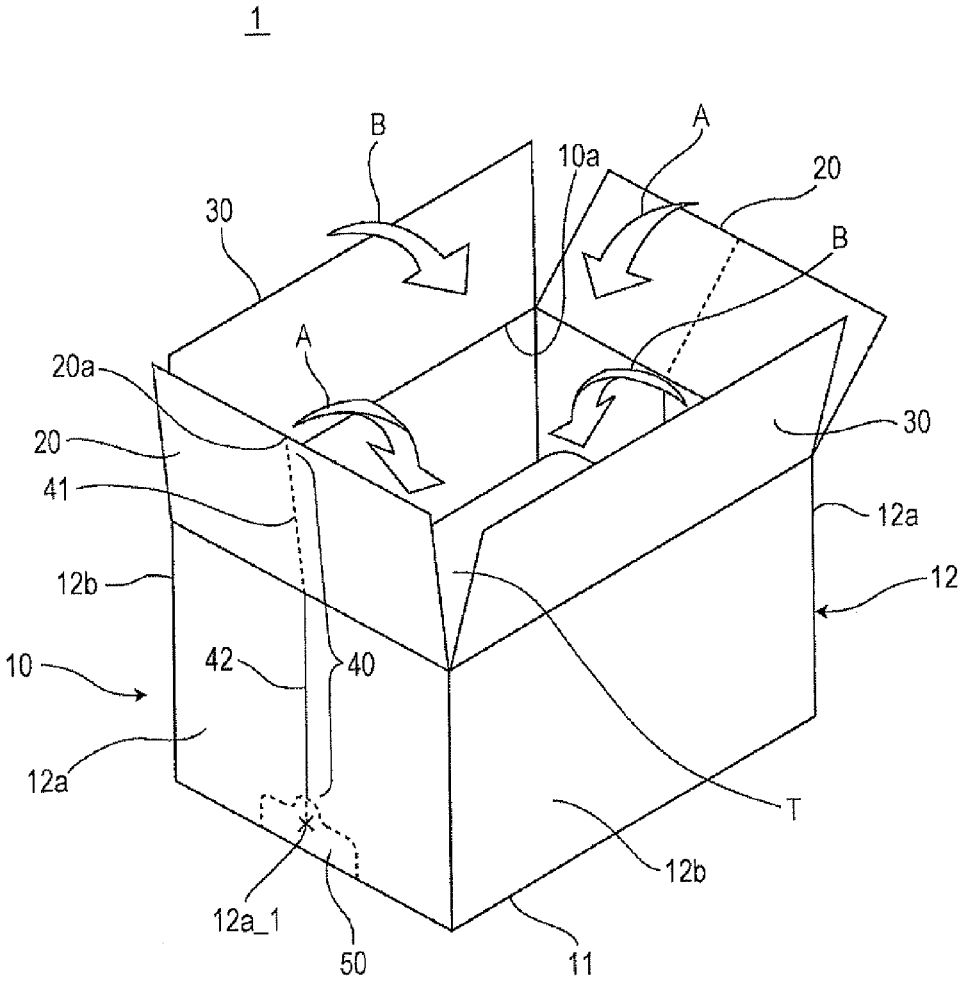
FIG. 1 illustrates a storage box according to a first exemplary embodiment of the present invention.

FIG. 1 illustrates a storage box 1 according to a first exemplary embodiment of the present invention.

The storage box 1 illustrated in FIG. 1 is a rectangular parallelepiped shaped box made of corrugated paperboard, and includes a box body 10, a pair of first lid walls 20, and a pair of second lid walls 30.

The box body 10 includes a rectangular bottom wall 11 and four side walls 12 that stand upright at respective sides of the bottom wall 11, and has an opening 10*a* at the top. An object T to be contained in the storage box 1 is put into and taken out of the storage box 1 through the opening 10*a*. The object T to be contained has a pair of handhold portions, which will be described below, that are located so as to face respective side walls 12*a* that oppose each other, one of the side walls 12*a* being at the near left side in FIG. 2 and the other side wall 12*a* being at the far right side in FIG. 2. A worker grabs the handhold portions when putting the object T into the storage box 1 or taking it out of the storage box 1.

The box body 10 corresponds to an example of a box body according to an exemplary embodiment of the present invention. The bottom wall 11 corresponds to an example of a bottom wall according to an exemplary embodiment of the present invention. The pair of side walls 12*a* corresponds to an example of a pair of side walls according to an exemplary embodiment of the present invention. The pair of first lid walls 20 corresponds to an example of a pair of lid walls according to an exemplary embodiment of the present invention.

The first lid walls 20 extend upward from the top edges of the respective side walls 12*a* such that the first lid walls 20 are bendable along the top edges of the side walls 12*a*. The first lid walls 20 are bent in the directions of arrows A along the top edges of the side walls 12*a*, thereby forming a lid that covers the opening 10*a* together with second lid walls 30 described below.

The second lid walls 30 extend from the top edges of a pair of side walls 12*b* other than the pair of side walls 12*a* such that the second lid walls 30 are bendable along the top edges of the side walls 12*b*. The second lid walls 30 are bent in the directions of arrows B along the top edges of the side walls 12*b* so as to cover the pair of first lid walls 20 in the above-described bent state from above, thereby forming a lid that covers the opening 10*a* together with the first lid walls 20.

When taking out the contained object T, the first lid walls 20 and the second lid walls 30 are opened to expose the opening 10*a*.

The pair of first lid walls 20 and the pair of side walls 12*a* connected to the respective first lid walls 20 are provided with lines 40 described below. The lines 40 correspond to an example of first lines according to an exemplary embodiment of the present invention.

Each line 40 lies along a line connecting a position 20*a* that is on the top edge of the corresponding first lid wall 20 and that is above the corresponding handhold portion when the first lid wall 20 is opened and raised while the object T is contained in the box body 10, and a position 12*a*_1 that is on the corresponding side wall 12*a* and that opposes the handhold portion. The line 40 lies along this line and extends partway to the bottom edge of the side wall 12*a*. The line 40 includes a lid segment 41 on the first lid wall 20 and a side wall segment 42 on the side wall 12*a*, and the lid segment 41 and the side wall segment 42 are a perforated line and a fold line, respectively.

The side walls 12*a*, on which the lines 40 are provided, have opening portions 50 located below the bottom ends of the side wall segments 42 of the lines 40. The opening portions 50 may be torn open along perforated lines to form holes in the side walls 12*a* when force is applied thereto. The opening portions 50 are opened by pivoting them about the bottom edges of the side walls 12*a*. The side wall segments 42 of the lines 40 extend to the opening portions 50. The opening portions 50 correspond to an example of opening portions according to an exemplary embodiment of the present invention.

When the contained object T is taken out, force is applied to the first lid walls 20 so that the first lid walls 20 are cut along the lid segments 41, which are perforated lines, of the lines 40, and force is also applied to the opening portions 50 so that the opening portions 50 are torn open along the perforated lines and holes are formed.

Figure 2:
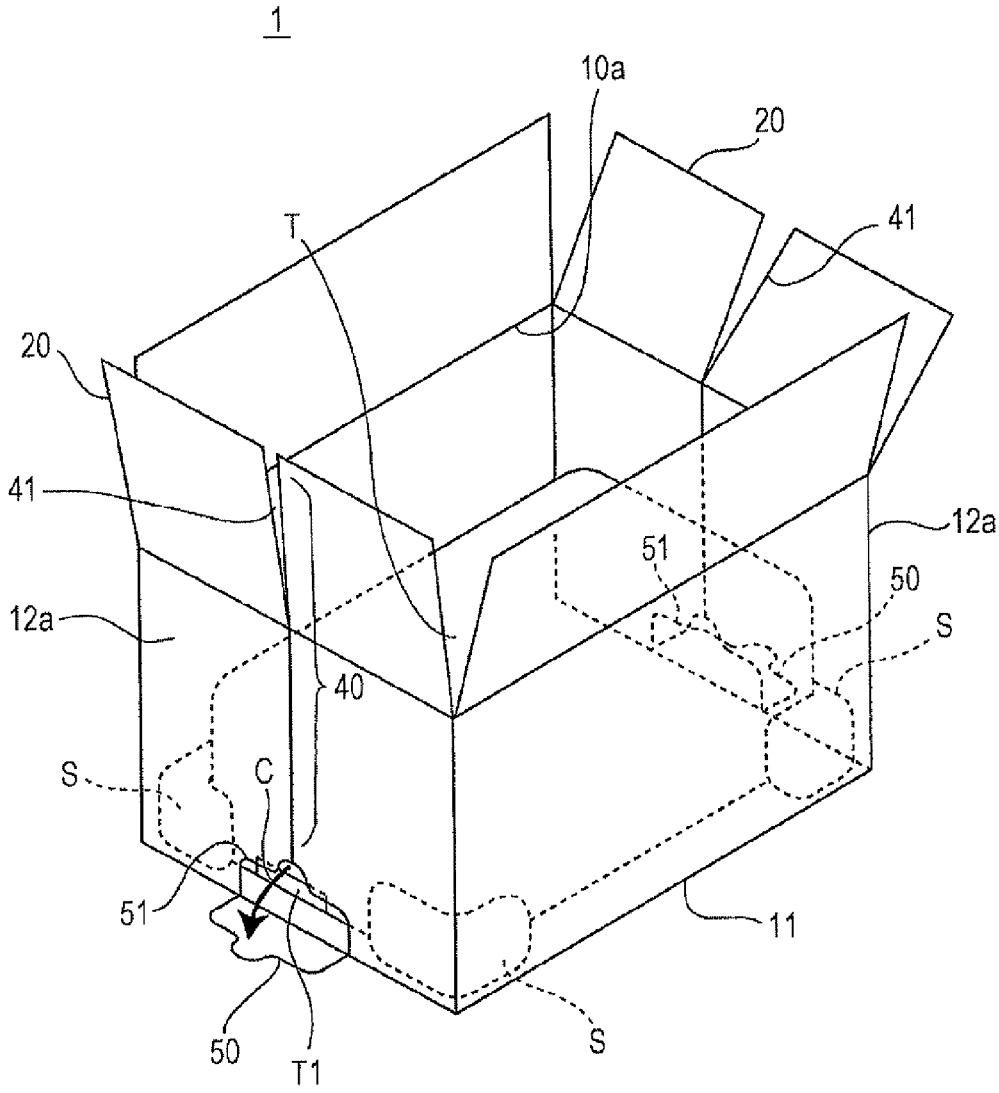
FIG. 2 illustrates the storage box in the state in which lid walls are cut along lid segments of lines and opening portions are opened.

FIG. 2 illustrates the storage box 1 in the state in which the first lid walls 20 are cut along the lid segments 41 of the lines 40 and the opening portions 50 are opened.

As illustrated in FIG. 2, when the first lid walls 20 are cut along the lid segments 41 of the lines 40, a cut is formed in each of the pair of first lid walls 20. When each opening portions 50 is opened in the direction of arrow C, a hole 51 is formed in each of the pair of side walls 12*a*.

As described above, the contained object T has handhold portions T1 that are grabbed when the contained object T is taken out. The opening portions 50 are positioned so as to face the respective handhold portions T1. Therefore, when the opening portions 50 are opened, the holes 51 are formed in the side walls 12*a* at positions corresponding to the handhold portions T1. The worker views the opening 10*a* of the storage box 1 from above when taking out the contained object T. Light enters through the holes 51 formed at the positions corresponding to the handhold portions T1 to illuminate the regions around the handhold portions T1, so that the worker may easily find the handhold portions T1.

The object T is contained in the storage box 1 while packing members S made of styrene foam are provided between the inner surface of the storage box 1 and four bottom corners of the contained object T. Accordingly, a gap corresponding to the thickness of the packing members S is provided between the outer surface of the contained object T and the inner surface of the storage box 1. When taking out the contained object T, the worker inserts his or her arms into the gaps between the sides of the contained object T on which the handhold portions T1 are formed and the side walls 12*a* of the storage box 1. The thickness of the packing members S is smaller than the thickness of the arms of the worker, so that the gaps into which the worker inserts his or her arms are smaller than the thickness of the arms of the worker.

Figure 3:
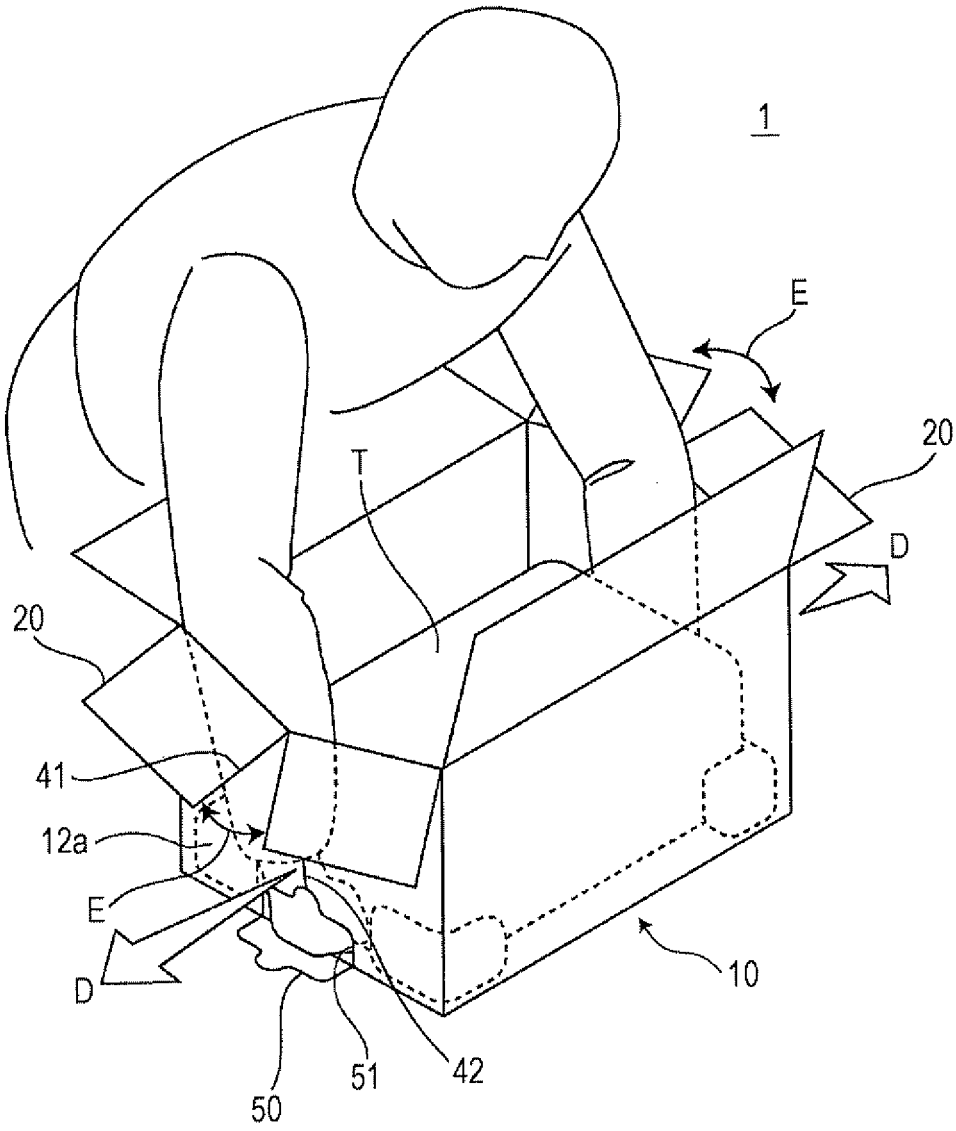
FIG. 3 illustrates the manner in which a worker inserts his or her arms into gaps between an outer surface of a contained object and side walls of the storage box, and grabs handhold portions.

FIG. 3 illustrates the manner in which the worker puts his or her arms into the gaps between the outer surface of the contained object T and the side walls 12*a* of the storage box 1, and grabs the handhold portions T1.

As described above, the gaps that are provided between the side surfaces of the contained object T and the side walls 12*a* of the storage box 1 and into which the worker inserts his or her arms to take out the contained object T are smaller than the thickness of the arms of the worker.

When the contained object T is taken out, the first lid walls 20, which are connected to the side walls 12*a* of the storage box 1, are cut along the lid segments 41 of the lines 40 (see FIG. 2) so that cuts are formed therein. The side wall segments 42, which are fold lines, of the lines 40 are provided on the side walls 12*a* of the storage box 1 so as to extend to the holes 51 formed when the opening portions 50 are opened.

When the worker inserts his or her arms into the above-described gaps, the side walls 12*a* of the storage box 1 are pushed from the inside by the arms and bent along the side wall segments 42, which are fold lines, in the directions of arrows D. In other words, the side walls 12*a* are bent outward toward the outside of the box body 10. When the side walls 12*a* are outwardly bent, the holes 51 are deformed so as to facilitate the outward bending of the side walls 12*a*. In addition, when the side walls 12*a* are outwardly bent, the cuts formed in the first lid walls 20 along the lid segments 41 widen in the directions of arrows E. As a result, the gaps that are provided between the side surfaces of the contained object T and the side walls 12*a* of the storage box 1 and that were initially small as described above widen to provide spaces that allow the worker to insert his or her arms deep enough to grab the handhold portions T1. The worker inserts his or her arms deep into these spaces, grabs the handhold portions T1, and takes the contained object T out of the storage box 1.

Next, a second exemplary embodiment will be described.

The second exemplary embodiment differs from the above-described first exemplary embodiment in that side walls of a storage box corresponding to the side walls 12*a* connected to the first lid walls 20 according to the first exemplary embodiment are provided with second lines, which will be described below. The difference between the second exemplary embodiment and the first exemplary embodiment will be mainly described.

Figure 4:
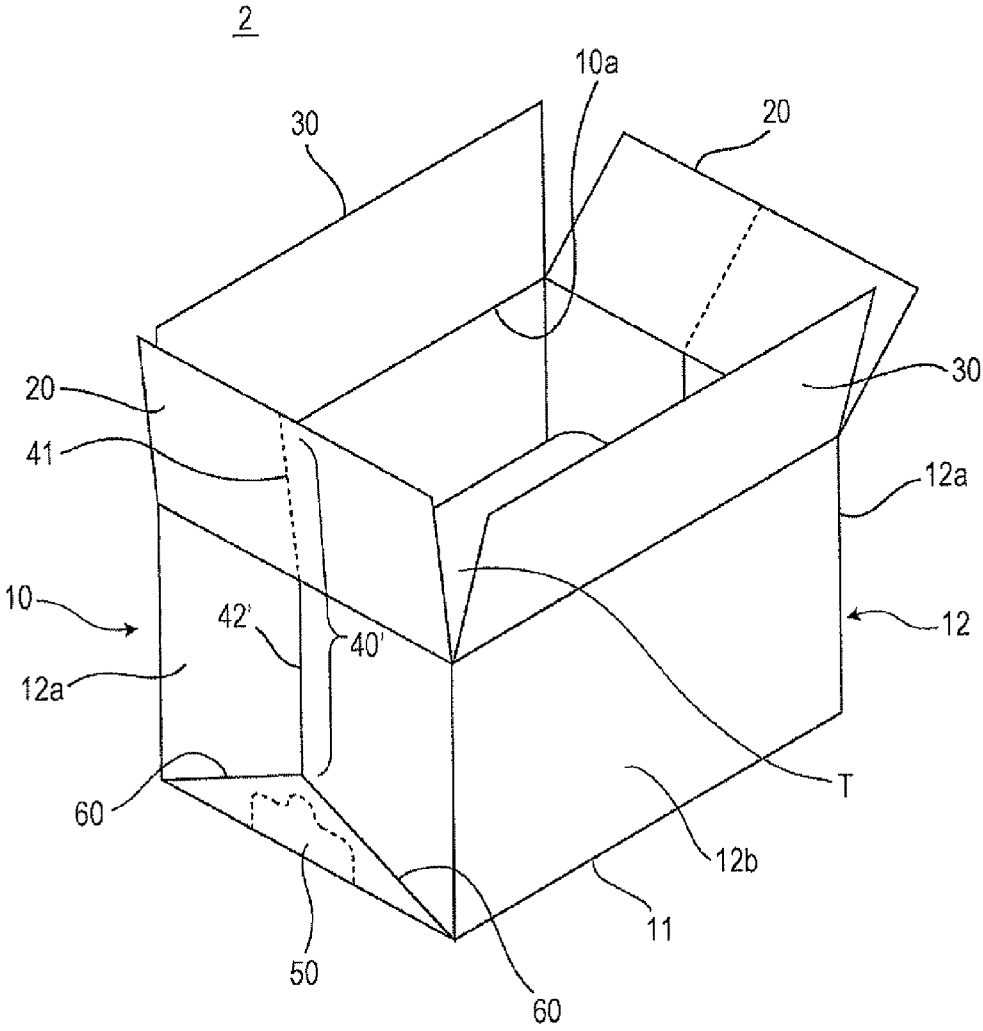
FIG. 4 illustrates a storage box according to a second exemplary embodiment of the present invention.

FIG. 4 illustrates a storage box 2 according to the second exemplary embodiment of the present invention.

In FIG. 4, components similar to those of the storage box 1 according to the first exemplary embodiment illustrated in FIG. 1 are denoted by the same reference numerals as those in FIG. 1, and explanations thereof are omitted in the following description to avoid redundancy. This also applies to FIG. 5, which will be referred to below.

In the storage box 2 illustrated in FIG. 4, side wall segments 42' of lines 40' provided on side walls 12*a*, which are connected to respective first lid walls 20, extend to positions above and separated from respective opening portions 50. Two second lines 60 extend from the bottom end of each side wall segment 42' to both ends of the bottom edge of the corresponding side wall 12*a*. The second lines 60 are fold lines that extend from the bottom end of the side wall segment 42' to both ends of the bottom edge of the side wall 12*a*. The lines 40' correspond to an example of first lines according to an exemplary embodiment of the present invention. The second lines 60 correspond to an example of second lines according to an exemplary embodiment of the present invention.

Figure 5:
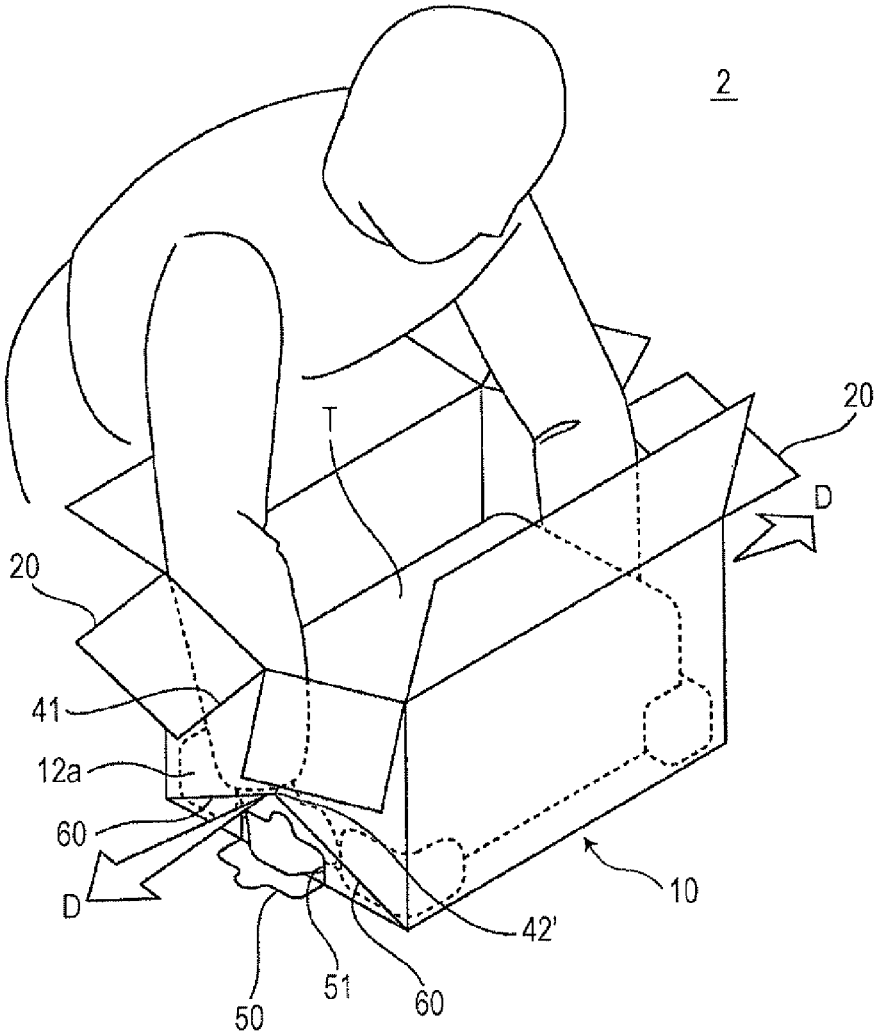
FIG. 5 illustrates the manner in which a worker puts his or her arms into gaps between an outer surface of a contained object and side walls of the storage box according to the second exemplary embodiment, and grabs handhold portions.

FIG. 5 illustrates the manner in which a worker puts his or her arms into gaps between an outer surface of a contained object T and the side walls 12*a* of the storage box 2 according to the second exemplary embodiment, and grabs handhold portions T1.

Similar to the above-described first exemplary embodiment, when the worker inserts his or her arms into the opening 10*a*, the side walls 12*a* are pushed from the inside and outwardly bent in the directions of arrows D along the side wall segments 42' of the lines 40'. The side walls 12*a* are also outwardly bent along the second lines 60, so that the second lines 60 facilitate the outward bending of the side walls 12*a* along the side wall segment 42'.

Therefore, according to the storage box 2 having the second lines 60, the side walls 12*a* may be more easily bent outward compared to the case in which the second lines 60 are not provided on the side walls 12*a* of the storage box 2.

Next, a third exemplary embodiment will be described.

In the third exemplary embodiment, segments of lines on lid walls that correspond to the first lid walls 20 according to the above-described first exemplary embodiment differ from the lid segments 41 of the lines 40 according to the first exemplary embodiment. The difference between the third exemplary embodiment and the first exemplary embodiment will be mainly described.

Figure 6:
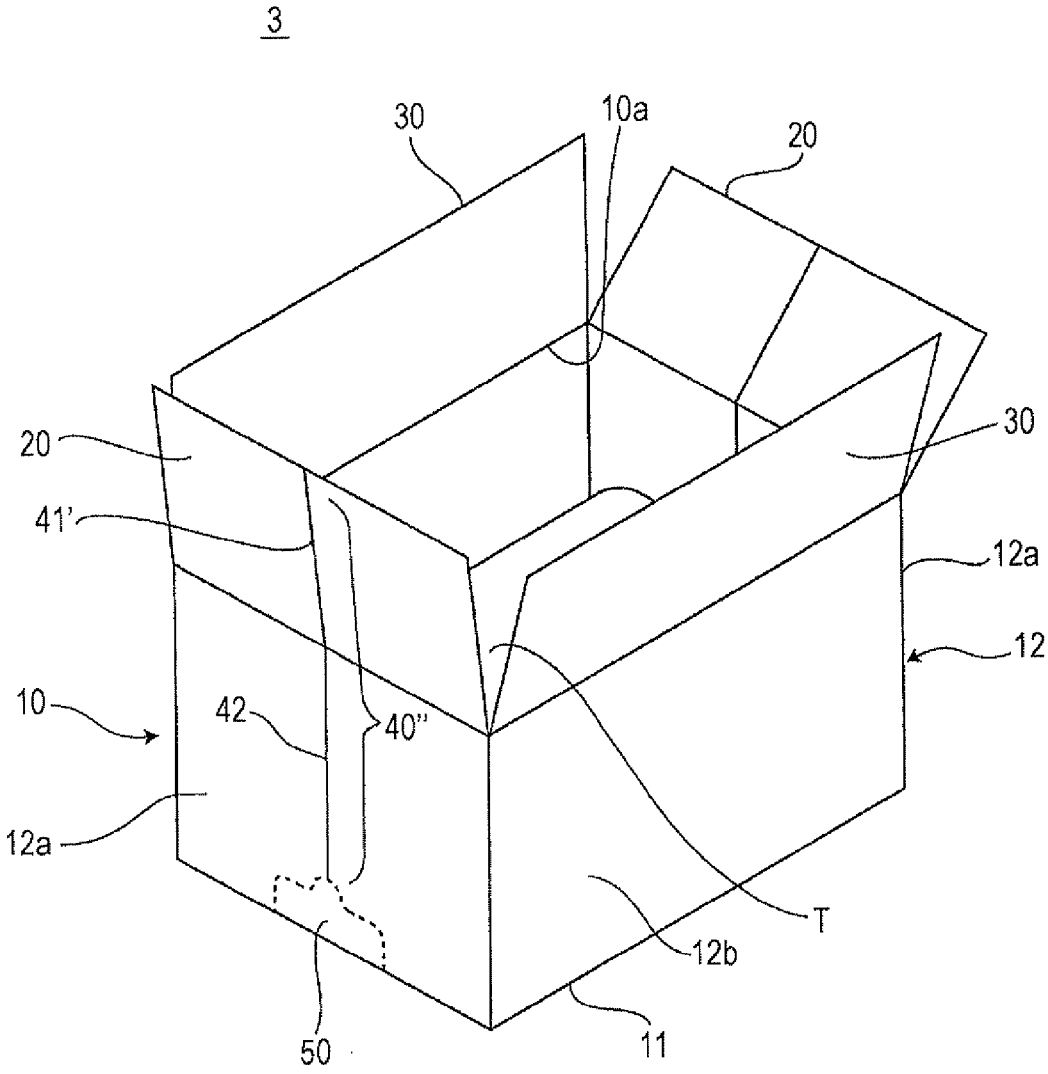
FIG. 6 illustrates a storage box according to a third exemplary embodiment of the present invention.

FIG. 6 illustrates a storage box 3 according to the third exemplary embodiment of the present invention.

In FIG. 6, components similar to those of the storage box 1 according to the first exemplary embodiment illustrated in FIG. 1 are denoted by the same reference numerals as those in FIG. 1, and explanations thereof are omitted in the following description to avoid redundancy. This also applies to FIG. 7, which will be referred to below.

In the storage box 3 illustrated in FIG. 6, lid segments 41' of lines 40" on first lid walls 20 are fold lines. The lines 40" correspond to an example of first lines according to an exemplary embodiment of the present invention.

Similar to the above-described first and second exemplary embodiments, a worker takes out an object T contained in the storage box 3 through an opening 10*a* by inserting his or her arms into gaps between the outer surface of the contained object T and side walls 12*a* of the storage box 3 and grabbing handhold portions. However, with the storage box 3, the worker grabs the handhold portions and takes out the contained object T while the pair of first lid walls 20 are raised, as described below.

Figure 7:
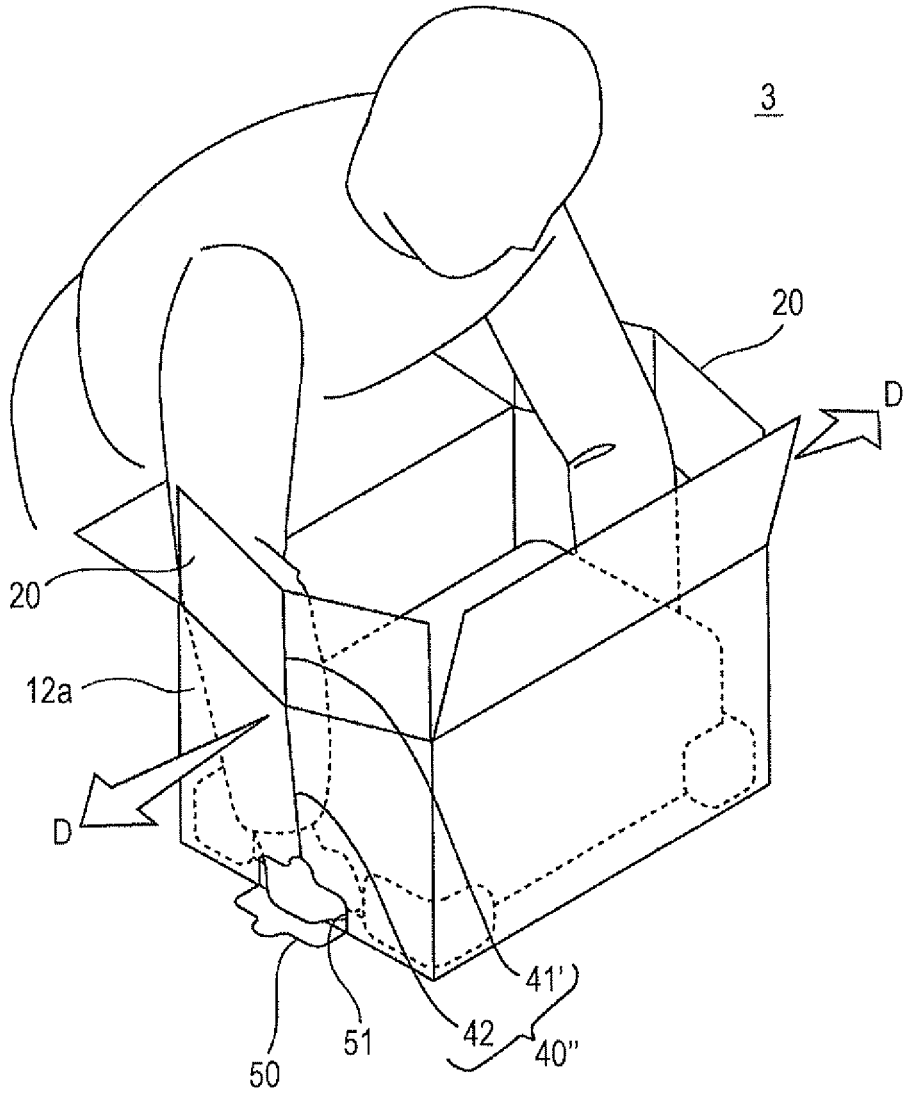
FIG. 7 illustrates the manner in which a worker puts his or her arms into gaps between an outer surface of a contained object and side walls of the storage box according to the third exemplary embodiment, and grabs handhold portions.

FIG. 7 illustrates the manner in which the worker puts his or her arms into the gaps between the outer surface of the contained object T and the side walls 12*a* of the storage box 3 according to the third exemplary embodiment, and grabs the handhold portions.

As illustrated in FIG. 7, the worker inserts his or her arms into the gaps between the outer surface of the contained object T and the side walls 12*a* of the storage box 3 while the pair of first lid walls 20 are raised. When the worker inserts his or her arms into the gaps, the first lid walls 20 are outwardly bent in the directions of arrows D together with the side walls 12*a* along the lid segments 41' of the lines 40".

Similar to the storage box 1 of the first exemplary embodiment and the storage box 2 of the second exemplary embodiment, the gaps between the side surfaces of the contained object T and the side walls 12*a* of the storage box 3 widen to provide spaces that allow the worker to insert his or her arms deep enough to grab the handhold portions.

In the above-described first to third exemplary embodiments, storage boxes including lid walls on which perforated lines or fold lines are formed as lines are described as storage boxes according to exemplary embodiments of the present invention. However, storage boxes according to exemplary embodiments of the present invention are not limited to this, and may instead include lid walls having cut lines as lines.

In addition, in the first to third exemplary embodiments, storage boxes including side walls having opening portions that are located below the bottom ends of the lines and that may be torn open along perforated lines to form holes in the side walls when force is applied thereto are described as storage boxes according to exemplary embodiments of the present invention. However, storage boxes according to exemplary embodiments of the present invention are not limited to this, and may instead include side walls in which holes are initially formed. Alternatively, a storage box according to an exemplary embodiment of the present invention may instead be formed such that no holes or opening portions are provided.

In addition, in the first to third exemplary embodiments, storage boxes in which the lines on the side walls extend partway to the bottom edges of the side walls and the opening portions are formed below the bottom ends of the lines are described as storage boxes according to exemplary embodiment of the present invention. However, storage boxes according to exemplary embodiments of the present invention are not limited to this, and may instead be formed such that no holes or opening portions are provided on the side walls and the lines extend to the bottom edges of the side walls.

In addition, in the first to third exemplary embodiments, corrugated paperboard boxes are described as storage boxes according to exemplary embodiments of the present invention. However, storage boxes according to exemplary embodiments of the present invention are not limited to this, and may instead be, for example, a box made of paper other than corrugated paperboard or a box made of a plastic plate that is thin enough to be outwardly bent as described above.

In addition, in the first to third exemplary embodiments, rectangular parallelepiped shaped boxes having rectangular bottom walls are described as storage boxes according to exemplary embodiments of the present invention. However, storage boxes according to exemplary embodiments of the present invention are not limited to this. A storage box according to an exemplary embodiment of the present invention may be a box having a polygonal prism shape, other than a rectangular parallelepiped shape, having a pair of side walls that oppose each other. For example, a storage box according to an exemplary embodiment of the present invention may have an octangular prism shape obtained by chamfering four corners of the rectangular bottom wall of the rectangular parallelepiped shape. Storage boxes according to exemplary embodiments of the present invention are also not limited to polygonal prism shaped boxes as long as the storage boxes include a pair of side walls that oppose each other. For example, a storage box according to an exemplary embodiment of the present invention may be a box in which side walls other than a pair of side walls are curved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A storage box comprising:

a box body that includes a bottom wall and a plurality of side walls including a pair of side walls that oppose each other, the box body having an opening at the top and containing an object; and a pair of lid walls that extend upward from top edges of the pair of side walls and are bent along the top edges so as to cover the opening of the box body, wherein a pair of first lines are formed on the pair of lid walls and the pair of side walls, each first line extending at least partway from a top edge of the corresponding lid wall to a bottom edge of the corresponding side wall and facilitating outward bending of the corresponding side wall when an arm is inserted between the object contained in the box body and the corresponding side wall, each first line extends partway to the bottom edge of the corresponding side wall, each first line has second lines connected to a bottom end thereof, the second lines extending from the bottom end to respective ends of the bottom edge of the corresponding side wall and facilitating the outward bending of the corresponding side wall together with the first line, and each of the pair of side walls has a hole or an opening portion that opens outwards such that a hole is formed, the hole or the opening portion being located at a bottom end of the corresponding first line, and the opening portion opens when a force is applied to the opening portion and the corresponding side wall is outwardly bent.

2. The storage box according to claim 1, wherein segments of the first lines on the lid walls are either cut lines or perforated lines.

3. A storage box comprising:

a box body that includes a bottom wall and a plurality of side walls including a pair of side walls that oppose each other, the box body having an opening at the top and containing an object; and a pair of lid walls that extend upward from top edges of the pair of side walls and are foldable along the top edges so as to cover the opening of the box body, wherein a pair of first lines are formed on the pair of lid walls and the pair of side walls, each first line extending at least partway from a top edge of the corresponding lid wall to a bottom edge of the corresponding side wall, and the pair of lid walls and the pair of side walls are foldable outward along the first lines, each first line extends partway to the bottom edge of the corresponding side wall, each first line has second lines connected to a bottom end thereof, the second lines extending from the bottom end to respective ends of the bottom edge of the corresponding side wall, and the corresponding side wall is foldable outward along the second lines, and each of the pair of side walls has a hole or an opening portion that opens outwards such that a hole is formed, the hole or the opening portion being located at a bottom end of the corresponding first line, and the opening portion opens when a force is applied to the opening portion and the corresponding side wall is outwardly bent.

4. The storage box according to claim 3, wherein segments of the first lines on the lid walls are either cut lines or perforated lines.

* * * * *